United States Patent [19]

Gupta et al.

[11] 4,297,250

[45] Oct. 27, 1981

[54] METHOD OF PRODUCING HOMOGENEOUS ZNO NON-LINEAR POWDER COMPOSITIONS

[75] Inventors: Tapan K. Gupta, Monroeville, Pa.; Herbert E. Pietsch, Mukwonago, Wis.

[73] Assignee: Westinghouse Electric Corp., Pittsburgh, Pa.

[21] Appl. No.: 110,278

[22] Filed: Jan. 7, 1980

[51] Int. Cl.[3] ..... H01B 1/08

[52] U.S. Cl. ..... 252/518; 264/61; 264/63; 264/66; 264/67; 264/104; 264/118

[58] Field of Search ..... 264/61, 63, 65, 67, 264/118, 104, 105, 66; 252/518, 520, 521, 519

[56] References Cited

U.S. PATENT DOCUMENTS

| | | | |
|---|---|---|---|
| 2,807,856 | 10/1957 | Frosch | 264/61 |
| 3,210,461 | 10/1965 | Berg et al. | 264/63 |
| 3,549,736 | 12/1970 | Waugh | 264/63 |
| 3,791,859 | 2/1974 | Hirayama | 264/62 |
| 3,917,778 | 11/1975 | Shiraki et al. | 264/63 |
| 3,953,371 | 4/1976 | May | 252/518 |
| 4,046,847 | 9/1977 | Kresge | 252/521 |
| 4,094,061 | 6/1978 | Gupta et al. | 264/61 |
| 4,111,852 | 9/1978 | Ho et al. | 264/61 |
| 4,124,667 | 11/1978 | Coppola et al. | 264/63 |
| 4,127,511 | 11/1978 | Klein et al. | 252/519 |
| 4,169,071 | 9/1979 | Eda et al. | 252/521 |
| 4,180,483 | 12/1979 | Ho et al. | 264/235 |

*Primary Examiner*—Jeffery R. Thurlow

*Attorney, Agent, or Firm*—D. P. Cillo

[57] ABSTRACT

A method of making a ZnO powder composition, which can exhibit non-linear V-I characteristics, comprises the steps of: (1) mixing about 75 mole % to about 98 mole % of small, finely divided, solid ZnO and about 2 mole % to about 25 mole % of at least one small, finely divided, solid additive oxide effective to produce nonlinear characteristics, with an aqueous binder solution comprising an organic, water soluble fugitive binder, to provide a slurry; (2) simultaneously drying, mixing and agglomerating the slurried solids into a mass of larger substantially spherical particles containing the finely divided solids and binder; (3) pressing a mass of the agglomerated particles, to provide a cohesive pressed green body; and then (4) heating the pressed body, first at a temperature rate increase effective to slowly decompose and remove the fugitive binder from the body and then heating at a temperature of between 1,050° C. to about 1,400° C. for a time effective to sinter together the particles of the body, forming ZnO grains; (5) crushing the sintered body to provide finely divided powder particle fragments; (6) passing the particle fragments through a means to measure particle size in a manner effective to provide at least two attached ZnO grain fragments per particle, to provide a non-linear ZnO powder; and optionally, (7) heating the non-linear ZnO particles at a temperature of between 500° C. and 1,050° C. and breaking up any agglomerates, to provide a finely divided powder which will exhibit non-linear V-I characteristics.

9 Claims, 3 Drawing Figures

METHOD OF PRODUCING HOMOGENEOUS ZNO NON-LINEAR POWDER COMPOSITIONS

BACKGROUND OF THE INVENTION

This invention relates to methods and means for producing a powder with non-linear voltage-current properties, that can be useful, for example, in eliminating corona in high voltage generators or other electrical machines having conductor extensions disposed in air or other gaseous medium. The dangers of corona, in high voltage machines are well known. For example, high voltage stator coils generally require the use of electrical stress grading systems along the exterior end portions of the coil for corona suppression. Without stress grading, the electric field along the surface of the coil can become sufficiently large, so that the air layer adjacent to the coil can break down, producing local corona and/or flashover from the high voltage leads to ground.

Several methods of preventing corona discharge and short-circuiting have been used. Berg et al., in U.S. Pat. No. 3,210,461, disclosed coated, insulated, exterior stator coil portions next to the grounded stator laminations, with a 10 mil thick coating of a semiconducting material. This material consisted of 1 part varnish binder and about 6 parts of finely divided non-linear silicon carbide powder, containing up to 4 wt.% of finely divided carbon. The resistivity of these silicon carbide coatings was non-linear, i.e., the resistivity varied with the voltage.

This method provided a useful stress grading for medium voltage machines operating at about a 25 KV voltage class. However, silicon carbide is abrasive, can be oxidized, and its manufacturing process does not yield easily reproducible results. In addition, its non-ohmic exponent of between 3 and 7 could be improved upon. What is needed is a powder having non-linear electrical properties with a non-ohmic exponent greater than 7.

SUMMARY OF THE INVENTION

It has been found that the above problems are solved and the above need met, by providing a non-linear zinc oxide powder doped with appropriate doping oxides, which can be used, for example, in a high voltage grading paint. This powder can also be used as a coating fired onto a high voltage insulator made of ceramic or resin material. Heretofore, ZnO has ben used in sintered, non-linear resistors, as taught by Gupta et al. in U.S. Pat. No. 4,094,061 and by Ho et al. In U.S. Pat. No. 4,111,852.

The method of making the homogeneous ZnO powder composition of this invention comprises the steps of: (1) mixing about 75 mole % to about 98 mole % of small, finely divided ZnO powder particles with about 2 mole % to about 25 mole % of small, finely divided, suitable modifying additive compound particles known to be effective to produce non-linear electrical characteristics, such as, preferably, $TiO_2$, $Ta_2O_5$, FeO, $In_2O_3$, $B_2O_3$, $Al_2O_3$, $SnO_2$, $Sn_3O_4$, $Mo_2O$, $SiO_2$, BaO, SrO, PbO, CaO, MgO and $CeF_3$, and most preferably $Bi_2O_3$, NiO, $Co_3O_4$, CoO, MnO, $MnO_2$, $Cr_2O_3$ and $Sb_2O_3$, their equivalents and their mixtures. This ZnO-additive is mixed with an aqueous binder solution comprising an organic, water soluble fugitive binder that will decompose at temperatures of between about 150° C. and 600° C., and an optional organic lubricating wax, to provide a slurry.

The weight ratio of mixed solid particles (ZnO and additive compounds): binder is preferably from about 100:1 to about 100:10. In step (2) the slurry is fed into a means to simultaneously dry, mix, and agglomerate the particles and binder, such as a freeze drying or preferably a spray drying-mixing apparatus, to form an agglomerated powder mass. In step (3) the mass of agglomerated powder is pressed at between about 36 kg./sq.cm. to about 2,250 kg./sq.cm. (500 psi. to 31,500 psi.) but preferably at between about 72 kg./sq.cm. to about 240 kg./sq.cm. (1,000 psi. to 3,350 psi), to provide a consolidated body of substantially uniform density. In step (4) the pressed body is dual heated, to form a sintered body, generally in the form of a pellet, first at a temperature rate increase effective to slowly decompose and burn off the binder and optional lubricant, and as a second step at a temperature of between 1,050° C. and 1,400° C. for a time effective to sinter the powder body, forming a mass exhibiting non-linear V-I characteristics.

After sintering, the pellet comprises ZnO ceramic grains having a rough diameter of up to about 15 microns, each grain appropriately doped with modifying additives. This doping of ZnO by the additive is primarily effective to produce electrical non-linearity characteristics. In step (5) the sintered body is crushed to provide finely divided particle fragments. In step (6) the particle fragments are passed through a means to limit maximum particle size, such as a standard Tyler screen, in a manner effective to provide a powder fraction wherein substantially all of the particles in the powder fraction can contain at least two attached, doped ZnO grain fragments, providing a powder exhibiting non-linear V-I characteristics.

Substantially all of the particles will thus be assured of comprising at least two ZnO ceramic grain fragments with modifying additive diffused into the ZnO at the grain boundary, thus providing non-linearity for each powder particle fragment. Optionally, in step (7) the non-linear ZnO powder is heated at a temperature of between 500° C. and 1,050° C., for a time effective to calcine the particles and to cure and eliminate microfractures caused by the crushing step, without re-sintering the particles, and then, any agglomerates are broken up, to provide a finely divided powder which will exhibit non-linear V-I characteristics.

The powder may be used with an insulating resin medium, such as a chlorofluorocarbon or the like, generally in a weight ratio of non-linear ZnO powder:resin solids of between about 20:1 to 2:1, to provide a resinous ZnO stress coat varnish. This varnish, which may be mixed with toluene or other similar type medium, to produce a proper viscosity, can be applied as a paint, to coils or other high voltage insulated conductors. The ZnO powder can also be fired onto a ceramic article such as a bushing.

BRIEF DESCRIPTION OF THE DRAWINGS

For a better understanding of the invention, reference may be made to the exemplary embodiments shown in the accompanying drawings, in which.

DESCRIPTION OF THE PREFERRED EMBODIMENTS

Figure 1:
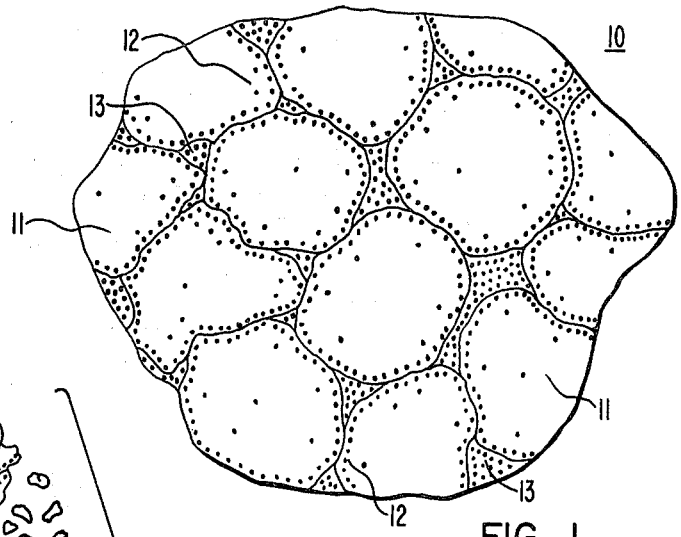
FIG. 1 is an idealized cross-sectional view through a sintered ZnO containing pellet prior to crushing.

According to the invention, there is provided a homogeneous ZnO powder composition, useful in, for example, voltage-non-linear stress coat varnishes for high voltage electrical apparatus. The initial powder comprises a major portion of from about 75 mole % to 98 mole %, preferably about 92 mole % to about 96 mole % of finely divided ZnO powder particles, and an effective minor amount of any finely divided, particulate additive compound that will cause electrical non-linearity completely within the bulk of a sintered oxide body comprising the ZnO and additive, generally between about 2 mole % to 25 mole %. These additives, which are well known in the art, are preferably selected from $TiO_2$, $Ta_2O_5$, FeO, $In_2O_3$, $B_2O_3$, $Al_2O_3$, $SnO_2$, $Sn_3O_4$, $Mo_2O$, $SiO_2$, BaO, SrO, PbO, NiO, CaO, MgO and $CeF_3$, and most preferably $Bi_2O_3$, NiO, $Co_3O_4$, CoO, MnO, $MnO_2$, $Cr_2O_3$ and $Sb_2O_3$, their equivalents and their mixtures.

The ZnO and modifying additive are mixed, in the proportions set forth above, as a first step to form a mixed oxide powder. The ZnO, and preferably, also the additive, as initially mixed will have a particle size diameter of between about 0.01 micron to about 1.0 micron, preferably between about 0.05 micron to about 0.4 micron. By "diameter" is herein meant the diameter of a circle that can be circumscribed around a particle if it has an irregular or rectangular shape. During the sintering step these ZnO particles will grow, to form ZnO grains.

This ZnO-additive mixture is then added to a blended binder solution comprising an aqueous solution of: (1) an organic, water soluble, liquid or solid fugitive binder such as, for example, polyvinyl alcohol, glycerin, triethanol amine, methyl cellulose, and hydroxy ethyl cellulose, with polyvinyl alcohol having a preferred molecular weight of between about 10,000 to 25,000, and optionally, (2) an organic fugitive lubricating wax, such as, for example, Beeswax, Carnauba wax, paraffin wax and preferably Carbowax, a solid waxy polyethylene glycol, and mixtures thereof. This provides a mixed oxide binder slurry which may include wax at this point.

Usually, the solid mixed oxides (ZnO and additive) will comprise about 10 wt.% to about 50 wt.% of the slurry. The weight ratio of mixed oxides:binder is preferably from about 100:1 to about 100:10. Less than 1 part binder per 100 parts mixed oxides will not provide sufficient "green strength" after subsequent low pressure pressing, for the material to be easily handled. This minimal amount of binder is critical in allowing the formation of large spherical agglomerates, which provide good flow, shear, and compaction properties, and allows low consolidation pressure and use of inexpensive dies. It is also critical in providing a minimum density gradient through the consolidated body even after low pressure single or double action uniaxial pressing. Over 10 parts binder per 100 part of mixed oxides will complicate the subsequent dual sintering step, because it will be very difficult to burn off all of the fugitive binder before completely sintering the molded body.

While use of lubricating wax in the slurry is optional, it significantly improves flow and shear properties during pressing. The weight ratio of mixed solid particles:-lubricant, when used, is preferably from about 100:0.1 to 100:4. Over 4 parts solid lubricant per 100 parts of mixed solid oxides will complicate the subsequent dual sintering step, because it will be very difficult to burn off all the lubricant before completely sintering the molded body.

In all cases, both the organic, water soluble, fugitive binder material and the organic, fugitive lubricant material must be capable of dispersing in water to form an emulsion, and must be able to completely decompose, evaporate, oxidate, or burn off the pressed body at temperatures below complete sintering of the mixed oxides, generally between about 150° C. to about 600° C., generally forming a gas and leaving no carbon residue harmful to the electrical properties of the final sintered body. Additionally, these materials should be able to withstand the average 200° C. temperature found in spray drying without polymerizing. Equivalent materials in addition to those preferred materials listed above can be easily determined by those skilled in the art.

Both of these materials must have minimal interaction with the ions present in the mixed oxide powder, so that the slurry mixture does not gel prior to the mix-agglomerating step. The viscosity of the slurry mixture should not exceed about 3,000 cps. at 25° C., otherwise freeze or spray drying techniques may not be useful. Both of these materials must of course also be able to withstand the pumping and atomizing to which they may be subjected.

This aqueous admixture of ZnO, additive and binder is preferably wet mill grind mixed for about 1 hour to 12 hours, but usually only about 1 to 4 hours, generally in a mill with cylindrical alumina, zirconia or silica media. This provides quick mixing and a marginally homogeneous mixture having a viscosity of about 50 cps. to about 3,000 cps. at 25° C. After wet mill mixing the aqueous admixture, it is preferably kept agitated, as by stirring, so that the solid particles do not settle.

The aqueous admixture is then fed into a spray or freeze drying apparatus which is effective to mix, remove water, cause agglomeration of the discrete solid oxide particles into larger smooth, substantially spherical shape, powder masses, and uniformly distribute the binder. The drying, mixing and agglomerating may be considered to occur essentially simultaneously in such apparatus. As many as 1,000 slurry particles can combine, as the result of binder inclusion in the slurry, to form a single, smooth, round shape agglomerate.

Of the two examples of suitable water removing and mix-agglomerating or mix-granulation means (freeze drying apparatus and spray drying apparatus) the latter is preferred as more convenient and because of actual successful experience therewith. Generally, in a freeze drying apparatus, the slurry is pressure sprayed into a cold (−70° C.) hexane bath. Water is removed from the solid spheres of particles and ice crystals by sublimation in a freeze dryer. The dried particles agglomerate and form spherical shape masses as a free flowing powder.

In spray drying, the slurry is atomized and pressure injected into a stream of hot air. If the slurry has a viscosity over about 3,000 cps. at 25° C., it will be difficult to atomize. Inlet temperatures, in the method of this invention, can be as high as about 390° C. without decomposing the binder and optional lubricating wax, due to the presence of water. Outlet temperatures are generally about 110° C. The average temperature in the apparatus will be about 200° C. The atomized slurry forms spherical globules upon introduction into the chamber, the water evaporates and the solid spheres of particles agglomerate and form spherical shape masses as a free flowing powder of agglomerates. The waste gases are exhausted and the dried agglomerated masses may be cyclonically separated into different size fractions. If different fractions are collected, they may be subsequently blended for about 0.5 hour to 3 hours in, for example, a tumbling V-blender to insure homogeneity of the mixed powder.

Both spray dry-mixing and freeze dry-mixing are effective means to evaporate the water and uniformly distribute the oxide particles and the organic binder within agglomerate, smooth, spherical shape masses. Both types of apparatus are well known in the art and reference may be made to *Ceramic Bulletin* Vol. 53: No. 3 (1974) at pp. 232 to 233, No. 5 (1974) at pp. 421 to 424, and No. 12 (1974) at pp. 850 to 852.

The dry mix-agglomerated material is next poured as a free flowing powder into a suitable die. It is then pressed, using a uni-axial die and plunger type press, preferably at between about 72 kg./sq.cm. to about 240 kg./sq.cm. (1,000) psi. to 3,350 psi.), although pressures as low as about 36 kg./sq.cm. or as high as 2,250 kg./sq.cm. may be used. The use of the binder and a specific agglomerate size distribution provides the powder with good flow, shear and compaction properties, and addition of the optional lubricant improves these properties.

The use of the binder, to allow large agglomerate masses comprising the powder, is primarily responsible for allowing low pressure pressing, and allowing the use of inexpensive graphite or steel dies, as a substitute for special carbide coated steel dies. The use of the binder provides a pressed body having sufficient "green strength" to be handled in a commercial processing operation prior to sintering. Of course, higher pressures, up to 1,500 kg./sq.cm., may be used.

The binder allows easy compaction and consolidation of the powder, and provides a substantially uniform density, i.e., one that will vary no more than about 10% throughout the pressed body. Generally after pressing, the density at the pressed ends of the body will vary between about 50% to about 60% of the theoretical density of the single phase pure ZnO. If the density at the end of the body is 55%, then the density in the middle of the body will be between about 55% and 45%.

Finally, the pressed powder is subjected to an essential two-staged heating process. The pressed body is placed in a suitable oven or other heating means, first at a low temperature, generally between about 100° C. to about 600° C. for a time effective to slowly decompose, burn off and eliminate all of the fugitive binder and optional fugitive lubricant, to leave no electrically conducting carbon residue. This step will usually take about 10 hrs. to about 35 hrs. at a temperature rate increase of between about 10° C./hr. to about 50° C./hr. Rates faster than about 50° C./hr. may result in cracks throughout the finished body. Most useful binders and lubricants will burn off at between about 200° C. to about 400° C.

As a second step, the powder body is finally heated at a temperature and for a time effective to completely sinter the powder masses together to form a homogeneous ZnO sintered body, generally at a temperature of between 1,050° C. to about 1,400° C., preferably between about1,100° to about 1,200° C., for about 1 to 5 hours. In the second step, the pressed body is heated at a temperature rate increase of between about 75° C./hr. to about 150° C./hr., to form a body exhibiting non-linear V-I characteristics. During this time the original ZnO particles having diameters between about 0.01 to 1 micron will combine and grow into ZnO grains about 10 times the original particle diameter.

Referring now to FIG. 1 of the drawings, an idealized cross section of a sintered ZnO body is shown. The sintered body 10, will comprise ZnO ceramic grains 11, which have grown from the original ZnO particles. The ZnO grains will have a maximum rough diameter of about 15 microns, generally about 1 to b 10 microns, each ideally doped by a thin diffused layer 12 of modifying additive. This doping layer of modifying additive is concentrated in and near the grain boundary region of the ZnO grains. The modifying additive also forms a separate phase at openings 13 between the grains. This doping of ZnO by additive diffusion is primarily effective to produce electrical non-linearity characteristics in the bulk ZnO ceramic when ZnO grains are in substantial contact with each other.

The voltage limiting characteristic of these materials is believed to be due to the character of the doped grain boundary within the bulk or body of the material, which is near-insulating at low voltage and conducting at a high voltage. Thus, on impressing a voltage, the resistance changes from a linear function of I (current) and V (voltage) i.e., Ohm's Law, to a power function of $I \alpha V^{\alpha}$, where $\alpha$, the non-ohmic exponent or non-linear coefficient, is a measure of non-linearity, and has a value greater than one. The non-linear coefficient can be easily calculated using well-known techniques.

The sintered body, generally in pellet form is then crushed by any suitable means, such as a mortar and pestle or hammer mill, to provide finely divided, fragmented particles. The fragmented particles, shown in FIG. 2 of the drawings, will comprise large and small particle fragments. The small particle fragments 20, will generally comprise minute ZnO grain fragments with no grain boundary, and they will not generally exhibit any substantial amount of non-linear V-I characteristics. These fragments are mainly composed of interior portions of the ZnO grains. The larger fragments 21 will comprise at least two doped ZnO ceramic grain portions joined together at their interface, with the modifying additive doping intact, along with portions of the separate additive phase 13 between the grains, thus providing non-linear V-I characteristics for those particle fragments. It is thought, that during grinding, the Zno grains shatter, with the outer portions containing the doped additive tending to remain attached to each other, the dopant additive acting as a type of cement. In most cases, microfractures or microcracks 22 will appear in the particles due to the crushing step.

The particle fragments are then passed through any suitable means to measure particle size, such as a Tyler, microscopic, or other type screening system. This is done in a manner effective to provide a retained powder fraction or portion of all the crushed powder, wherein substantially all of the particles in this retained powder fraction contain at least two doped, attached, adhering or contacting ZnO grain fragments per particle. By "substantially all" is meant that at least about 85% of the particles have at least two doped, attached ZnO ceramic fragments.

Figure 2:
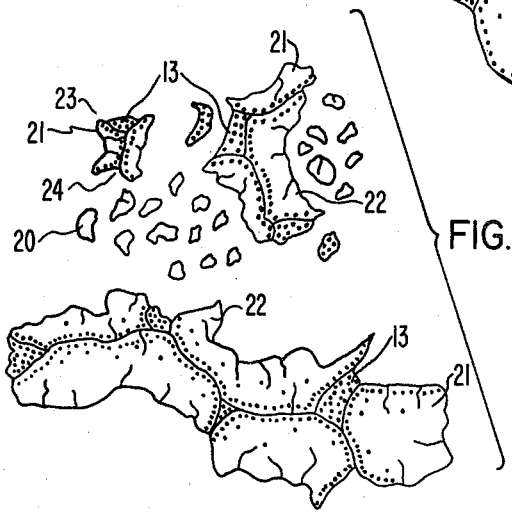
FIG. 2 is an idealized cross-sectional view through particle fragments of the pellet after crushing, showing some small particles containing only one ZnO ceramic grain fragment and other larger particles containing at least two ZnO ceramic grain fragments doped with additive oxide.

Thus, if the initial ZnO particles were 0.5 micron in diameter, during sintering they would combine and grow, and might form ZnO grains as large as 10 microns in diameter. By way of illustration, if the ZnO grains were all 10 microns in diameter in the sintered body, after the crushing step and fragmenting of the grains, the powder fraction retained and containing doped, attached ZnO fragments may have particle diameters as low as about 2 microns and as high as 1,000 microns. As can be seen in FIG. 2 of the drawings, a particle containing two, attached, doped ZnO fragments, shown as 23, can be very small, as low as 1/10 the diameter value of each parent ZnO grain in the original sintered body. In theory, in order to provide non-linear V-I characteristics, the required active doped diffusion distance for the additive need only be between about 0.025 to 0.05 micron on each side of the grain boundary 24 .

Accordingly, the fragment particle size will be screened to retain approximately about 1/10 the diameter of substantially all of the ZnO grains in the sintered body, i.e., if 85% of the ZnO grains in the sintered body are about 10 microns or larger, then the desired and retained fraction of the powder will be retained on a $(10+10)/10=2$ micron screen, in order to assure at least two, doped, attached ZnO grain fragments per retained particle. The two smallest attached grains measure 20 microns, and each can shatter to 1/10 their original diameter, so their smallest combined size is 2 microns.

Well-known polishing, etching and optical and scanning electronic microscopic techniques are used to observe and determine the ZnO grain and grain fragment size. The powder, comprising substantially all particles having at least two contacting, doped ZnO grain fragments is then preferably heated in an oven or other suitable heating means at a temperature of between 500° C. and 1,050° C., for a time effective to calcine the particles and to eliminate the microcracks, generally from about 15 minutes to about 4 hours. During this heating step, the additive ceramic will flow to some degree, to heal and close any microcracks formed during crushing, to form a crack-free consolidated particle. It is preferred that the microcracks be eliminated, in order to provide maximum non-linear V-I characteristics.

Finally, any agglomerates formed by heating are broken up by any suitable means, to provide a finely divided powder which will exhibit non-linear V-I characteristics. This powder is non-abrasive, already oxidized, can be easily reproduced and provides a non-ohmic exponent of between about 5 to 35. This powder can have many uses, including use in stress coat varnishes, and fired-on glass coatings.

Figure 3:
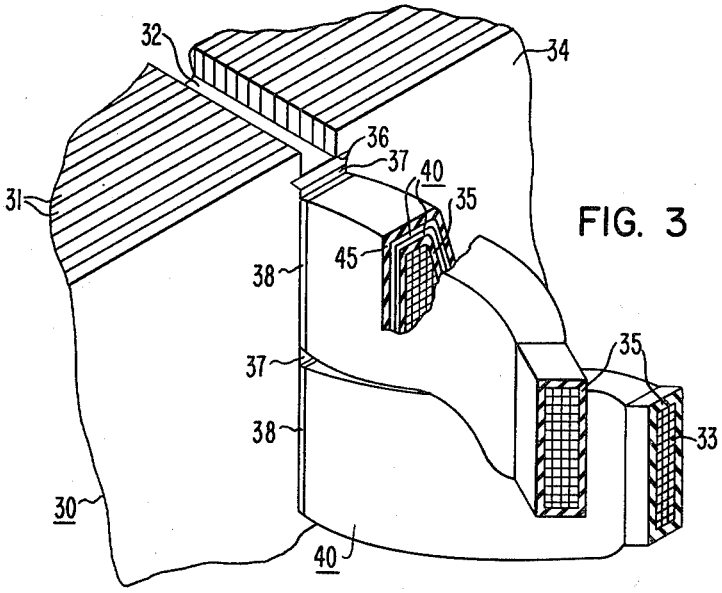
FIG. 3 is an isometric fragmented view of the exterior coils of an electrical apparatus having the non-linear ZnO stress coat composition of this invention applied thereto.

Referring now to FIG. 3 of the drawings, a portion of an electrical apparatus such as part of the stator of a dynamoelectric machine is shown. The stator includes a magnetic core 30 that comprises a plurality of stacked laminations 31. In the portion of the structure shown, the magnetic core 30 is provided with a slot 32 within which are positioned electrical members adapted for high voltage use, such as conductor coils. These coils extend out of the slot to provide exterior conductor end portions 33, which are shown on fragmented and cross-sectioned views, extending outward from the end faces 34 of the magnetic core.

A coating of insulation 35 is disposed about the conductor coils 33 both within and outside of the slot. This insulation may be a coating or tape comprising epoxy resin, or the like, used alone or in conjunction with mica. A conventional slot wedge 36 of insulating material may be provided to secure the coils within the core. A conventional filler strip 37 of insulating material may also be disposed between the two coils and between the coil and the slot wedge. Also shown, is conducting varnish coating 38, which covers a portion of the insulation 35 on the slot portion of the coil, and in the slot 32 of the magnetic core. The conducting varnish extends about 4 inches to 10 inches outwardly, from the end face of the core. This conducting varnish generally consists of an insulating varnish base loaded with conducting particles, such as carbon and the like.

The ZnO stress grading system 40 using this invention is coated onto the coils before insertion into the slots of the magnetic core. As shown, the grading system begins close to the face of the core. It may also begin a greater distance from the coil as where the coil begins to bend. The grading system 40, generally is in contact with, and overlaps the exterior portion of the conducting varnish coating. Also shown is a final track-resistant overcoat of insulating varnish 45.

The ZnO stress grading varnish composition comprises an insulating varnish base, such as epoxy resin, chlorofluorocarbon resin, vinyl toluene modified alkyd resin, styrenated epoxy resin and the like, loaded with generally contacting non-linear ZnO additive oxide permeated particles. In the ZnO stress grading varnish, the weight ratio of ZnO powder:resin solids is between about 20:1 to 2:1, preferably 12:1 to 2:1. Above 12:1, the varnish paint starts to become difficult to spread evenly, below 2:1, there is not enough ZnO powder contact. This varnish can be applied as a paint, alone or in a toluene, xylene or other similar type solvent medium.

The powder of this invention can also be mixed with a binder such as a solution consisting of 2 percent nitrocellulose isobutyl acetate, which can then be applied to a high voltage ceramic insulator. Upon firing, the binder burns off and the glass melts to bind the ZnO powder to the insulator surface, as taught by Hirayama in U.S. Pat. No. 3,791,859, herein incorporated by reference.

At very low currents, the current through the powder is proportional with the voltage. At increasing currents, the resistance of additive coated ZnO powder becomes increasingly non-linear, and at currents between about $10^{-4}$ and $10^{-3}$ amp per contact point, the current I, will follow the equation $I=K.V^{\alpha}$, where K is a material constant, V is voltage and $\alpha$, the non-linear coefficient, is a number above 1. This non-linearity of the additive coated ZnO powder may be easily determined by measuring voltage at various currents in a cylindrical column containing the powder and having a diameter of about 0.188 inch, where the powder is placed in the column between electrodes at a pressure of between 25 to 100 psi. For satisfactory non-linear stress-grading coatings, $\alpha$ in the formula above, should be at least 2 and preferably above 5.

EXAMPLE 1

A 100 gram ZnO composition was made by admixing 87.68 grams (95 mole %) of reagent grade ZnO, 5.62 grams (1 mole %) of reagent grade $Bi_2O_3$, 2.41 grams (1 mole %) of reagent grade $Co_3O_4$, 0.81 grams (1 mole %) of reagent grade $MnO_2$, 1.72 grams (1 mole %) of reagent grade $Cr_2O_3$ and 3.31 grams (1 mole %) of reagent grade $Sb_2O_3$. This provides a composition of 95 mole % ZnO and 5 mole % additive oxides. Both the ZnO and additive oxides, as initially mixed, had particle size of about 0.25 micron diameter and were of irregular shape.

A binder solution was made by blending and dissolving 3 grams of solid, polyvinyl alcohol binder having a molecular weight of about 13,000 to 15,000 and 0.5 grams of a solid polyethylene glycol wax having a molecular weight of about 150 to 250 (sold commercially by Union Carbide under the trade name Carbowax) in 240 grams of water.

The ZnO+additive oxide composition was added to the binder solution to provide a mixed oxide binder lubricant slurry containing about 29 wt.% oxides. The weight ratio of mixed solid oxide particles:binder was 100.3 and the weight ratio of mixed solid oxide particles:lubricant was 100:0.5. The fugitive (to be eliminated) binder material had a decomposition temperature of between about 210° C. to about 250° C., and the fugitive lubricant had a decomposition temperature of between about 265° C. to about 305° C. The slurry was mixed for 2 hours in a ball mill with cylindrical alumina media. The resulting slurry did not gel, showed a fair amount of homgeneity, had a specific gravity of 1.34 and a viscosity of 360 cps. at 25° C. using a Brookfield Spindle Viscometer. The slurry was emptied into a Nalgene (polyethylene) drum equipped with a stirrer and agitated continuously by stirring.

A Nichols Spray Dryer with a screw feed pump was first put into operation using water as the feed material for 2 hours to complete operating stabilization. The water was then cut off and the above-described slurry pumped into the spray dryer at a constant feed rate (dial setting $5\frac{1}{3}$) with an atomization pressure of about 3.8 kg./sq.cm. The burner temperature was 900° C., giving an inlet temperature of 390° C. and an outlet temperature of 125° C. In this spray drying step, the slurry is rapidly heated, the water evaporates, the oxides, binder and wax are ultra-homogeneously mixed, and the discrete irregular particles agglomerate and form large, smooth, spherical shape agglomerates in the form of free flowing powder.

The mix agglomerated powder was poured into a regular steel die having about a 3.8 cm ($1\frac{1}{2}$ in.) diameter. Cylindrical discs were fabricated by employing standard double action pressing (floating die) at 214 kg./sq.cm. (3,000 psi.). The "green" cylindrical pressed body was easily removed from the die. It was strongly consolidtated and easily handled, demonstrating excellent "green strength". It was about 55% dense and appeared to be extremely uniform in density through its thickness.

The pressed cylindrical disc was then placed in a Burrell electrically heated tube furnace with an open-ended rectangular cross-section high alumina tube incorporating a heating zone of about 15.24 cm. (6 in.) long. The pressed body was placed on 50 to 100 mesh zirconia in a zircon refractory boat. The furnace was raised from 25° C. to 288° C. at a temperature rate increase of 24° C./hr. and held at that temperature for 14 hours to allow slow decomposition burnoff and removal of all of the fugitive binder and wax from the pressed disc. As a second heating step, the temperature was then raised rapidly to 1,200° C. at a temperature rate increase of about 120° C./hr. and held at that temperature for 2 hours to allow complete sintering of the ceramic body.

After heat treatment, the sample diameter was about 2.84 cm., and the height was about 0.58 cm. The sample was about 95% dense and appeared to be completely homogeneous and almost completely uniform in density through its thickness. A slice of the same was ground, polished and etched in nitric acid to reveal the grain boundary structure. The ZnO grains were observed to be at least about 85% between at least about 10 to 15 microns diameter, using a 500 power optical microscope.

Thus, to provide two ZnO grains per particle upon crushing, the crushed particles would have to have sizes over about 2.0 microns diameter, i.e., since each grain is about 10 microns, and crushing would, at the most, reduce the grain to about 1/10 size, a two grain combination should be the minimum allowable in the particle fraction saved to be used in the stress grade paint.

Five samples were crushed in a mortar and pestle. These powders were then screened to provide sample powders having the following approximate particle sizes: (A) all approximately 595 microns diameter (30 mesh), (B) all approximately 105 microns diameter (140 mesh), (C) all approximately 74 microns diameter (200 mesh), (D) all approximately 37 microns diameter (400 mesh) and (E) a sample having a particle size range distribution where 86% of the particles were over 2 microns diameter, 57% of the particles were over 5 microns diameter, 18% of the particles were over 10 microns diameter and 3% of the particles were over 20 microns diameter.

Sample (E) was calcined in a heated tube furnace at about 600° C. for 1 hour, to cure any microcracks in the powder particles, without resintering them. After this calcining, a few agglomerates were formed which were easily broken up, to provide free flowing, already oxidized, non-abrasive sample powder, where substantially all of the powder particles contained at least two contacting, additive doped ZnO grains.

The various sample powders were then electrically tested to determine the degree of non-linearity present. The test chamber for the powder was a polycarbonate block with a 0.188 inch diameter hole drilled through it. Two brass rods inserted into the hole from opposite ends formed a cavity for the powder. The cavity was filled to a depth of $\frac{1}{4}$ inch to $\frac{5}{8}$ inch with the powder and a pressure of 25 to 100 psi was applied to the powder. A 10 kV dc power supply was used to apply a known voltage to the powder sample and a $3\frac{1}{2}$ digit dc ammeter (0.1 nanoampere sensitivity) was used for the current measurement. The slope of current vs. volts/mil plot for each sample was used to define the non-linear coefficient of Samples (A) through (E). The results are shown in Table 1 below:

TABLE 1

| Sample | Approximate Diameter (microns) | Non-linear Coefficient (at 25 psi) |
|---|---|---|
| (A) | 595 | 5.5 |
| (B) | 105 | 12.3 |
| (C) | 74 | 5.43 |
| (D) | 37 | 8.42 |
| (E) | 86% over 2<br>57% over 5<br>18% over 10<br>3% over 20 | 23.6 |

As can be seen, the ZnO powder shows non-linear V-I characteristics after crushing the parent disc, and screening to a particular particle size range. The non-linear coefficient values recorded above may be low since only 25 psi pressure was used in their determination. At pressures of about 75 to 100 psi, where measurements would more closely approximate individual particle measurement, the non-linear coefficient could be expected to be between about 25 and 35. Higher values could also be expected if the parent disc were sintered for a longer time period, such as 4 hours instead of 2 hours. Calcining, as in Sample (E), is shown to be particularly effective and preferred, providing almost double the non-linear coefficient.

Samples similar to Sample (E) composition were then mixed into a 50% solids solution of a vinyl toluene modified alkyd resin, to provide a weight of non-linear ZnO powder:resin solids of about 12:1 to 2:1. The viscosity of the mixture was adjusted to allow brushing, by adding 1 part of solvent for each 5 to 7 parts of powder and resin. This stress grading paint composition was painted on a $\frac{1}{2}''\times 2''\times 45''$ long aluminum conductor which had been previously wrapped with mica tape and resin vacuum impregnated with epoxy resin. The composition was painted around the circumference along a 3" length of the mica covered aluminum bar. Then, a strip of carbon black filled conducting varnish was painted around the circumference on each side of the stress grade paint. Electrical connections were made to each strip of carbon conducting varnish and a dc voltage was applied. This environment simulated stress grading coil coatings on dynamoelectric machines. No arcing was observed and the current voltage characteristic was observed using a storage oscilloscope. The V-I curve on the oscilloscope screen showed the desired non-linear behavior required for the stress grading application.

We claim:

1. A method of making a ZnO powder composition, which can exhibit non-linear V-I characteristics, comprising the steps of:

(1) mixing:

(a) 75 mole % to 98 mole % of finely divided, ZnO particles and 2 mole % to 25 mole % of finely divided, additive particles effective to produce non-linear V-I characteristics, with (b) an aqueous binder solution comprising an organic, water soluble binder that will decompose at temperatures of between about 150° C. and 600° C., to provide a mixed particle-binder slurry, and then (2) simultaneously dry, mix, agglomerating the slurry to form a mass of larger spherical particles, said particles containing binder, ZnO and additive compound distributed therethrough, and then (3) pressing a mass of the agglomerated particles to provide a consolidated body, and then (4) heating the pressed body:

(a) first at a temperature rate increase effective to slowly decompose and remove the binder, and then, (b) between about 1,050° C. and 1,400° C., for a time effective to sinter together the particles of the pressed body, forming additive doped ZnO grains within a body exhibiting non-linear V-I characteristics, and then (5) crushing the sintered body to provide finely divided powder particle fragments, and then (6) passing the finely divided particle fragments from the crushed sintered body through a means to measure particle size, in a manner effective to provide a powder fraction where substantially all of the particles in the powder fraction contain at least two attached additive doped ZnO grain fragments, providing a powder exhibiting non-linear V-I characteristics, where said fragments contain microfractures after crushing, and then (7) heating the non-linear particles at a temperature of between 500° C. and 1,050° C., to eliminate any microfractures without re-sintering the particles.

2. The method of claim 1, wherein the additive compound is selected from the group consisting of $TiO_2$, $Ta_2O_5$, FeO, $In_2O_3$, $B_2O_3$, $Al_2O_3$, $SnO_2$, $Sn_3O_4$, $Mo_2O$, $SiO_2$, BaO, SrO, PbO, NiO, CaO, MgO, $CeF_3$, $Bi_2O_3$, $Co_3O_4$, CoO, MnO, $MnO_2$, $Cr_2O_3$ and $Sb_2O_3$ and mixtures thereof.

3. The method of claim 1, where, as a last step, the non-linear ZnO powder is dispersed in a resinous medium, to provide a ZnO stress grading paint composition.

4. The method of claim 1 wherein the aqueous binder solution also contains an organic lubricating wax that will decompose at temperatures of between about 150° C. to about 600° C., wherein the weight ratio of mixed ZnO and additive particles:lubricant is between about 100:0.1 to about 100:4.

5. The method of claim 1, wherein the mass is pressed in step (3) at between about 36 kg./sq.cm. to about 1,500 kg./sq.cm., heated in step (4) (1) between 25° C. to about 600° C. at a range of between about 10° C./hr. to about 45° C./hr., to eliminate all of the binder, and wherein the temperature rate increase in step (4) (2), to sinter the particles is between about 75° C./hr. to about 150° C./hr.

6. The method of claim 1, wherein spray-drying is used to simultaneously dry, mix and agglomerate in step (2).

7. The method of claim 1, wherein the additive compound is selected from the group consisting of $Bi_2O_3$, NiO, $Co_3O_4$, CoO, MnO, $MnO_2$, $Cr_2O_3$, $Sb_2O_3$ and mixtures thereof, and wherein the weight ratio of solid particles:binder in the mixing step is between about 100:1 to about 100:10.

8. The method of claim 1, wherein, after sintering of step (4) (b) the ZnO particles form attached, additive doped ZnO grains, which after crushing in step (5) are fragmented and reduced in size up to 1/10 their original diameter, and the powder fraction in step (6) caught in a screening means consists of at least 85% particles having at least two attached, additive doped ZnO grains.

9. The method of claim 3, where the weight ratio of non-linear ZnO powder:resin solids is between about 20:1 to 2:1.

* * * * *